US005281187A

United States Patent [19]

Whitney, Jr.

[11] Patent Number: 5,281,187

[45] Date of Patent: Jan. 25, 1994

[54] UNITARY VENT AND DUCT ASSEMBLY

[76] Inventor: Harry R. Whitney, Jr., 17 Longbranch Ct., Taylorsville, Ga. 30178

[21] Appl. No.: 973,645

[22] Filed: Nov. 9, 1992

[51] Int. Cl.[5] ..... F24F 13/06

[52] U.S. Cl. ..... 454/296; 454/292; 248/343

[58] Field of Search ..... 454/292, 296, 297, 298, 454/330, 331, 332; 248/343

[56] References Cited

U.S. PATENT DOCUMENTS

| | | | |
|---|---|---|---|
| 2,342,965 | 2/1944 | Palmer | 454/331 |
| 2,662,743 | 12/1953 | Frenger | 454/296 X |
| 2,734,446 | 2/1956 | O'Day | 454/292 |
| 3,327,606 | 6/1967 | Little et al. | 248/343 |
| 4,088,293 | 5/1978 | Delmore | 248/343 X |
| 4,122,762 | 10/1978 | Williams | 454/292 |
| 4,159,674 | 7/1979 | Brumleu, Jr. | 454/297 |
| 4,760,981 | 8/1988 | Hodges | 248/343 X |

FOREIGN PATENT DOCUMENTS

| | | | |
|---|---|---|---|
| 1232875 | 5/1971 | United Kingdom | 454/292 |

*Primary Examiner*—Harold Joyce
*Attorney, Agent, or Firm*—Hopkins & Thomas

[57] ABSTRACT

A unitary vent and duct assembly for installation within a framed section of a suspended ceiling structure comprises a cowling having a substantially closed top end and a substantially closed bottom end. The bottom end of the cowling is covered with a foraminous grill that allows passage of air into or out of the assembly. The assembly is sized to fit within a framed section of a suspended ceiling structure and has a plurality of spring biased barb bearing clips arrayed about its periphery. A semi-rigid flexible and lengthwise expandable duct is coupled to the top portion of the cowling and communicates with the interior thereof. In use, the vent and duct assembly is pressed into place within a framed section of a suspended ceiling structure, whereupon the peripheral clips engage and fasten to the struts of the ceiling structure to hold the assembly firmly but releasibly in place. The flexible duct can then be pulled away from the cowling and toward a main supply or return duct to which it is to be coupled. The flexible duct, being semi-rigid, maintains its shape and length as it is stretched away from the cowling to eliminate kinks and sags. Further, since the assembly is securely held in place with its peripheral clips, the pulling of the flexible duct does not dislodge the assembly.

8 Claims, 3 Drawing Sheets

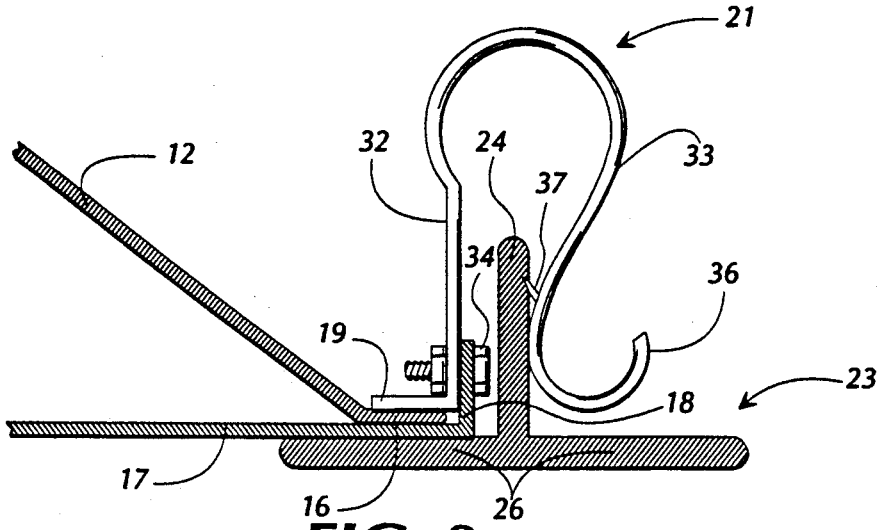
FIG. 3
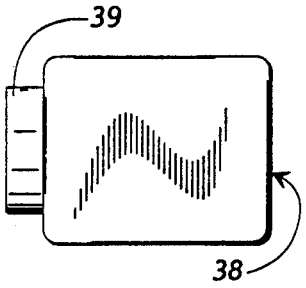
FIG. 4A
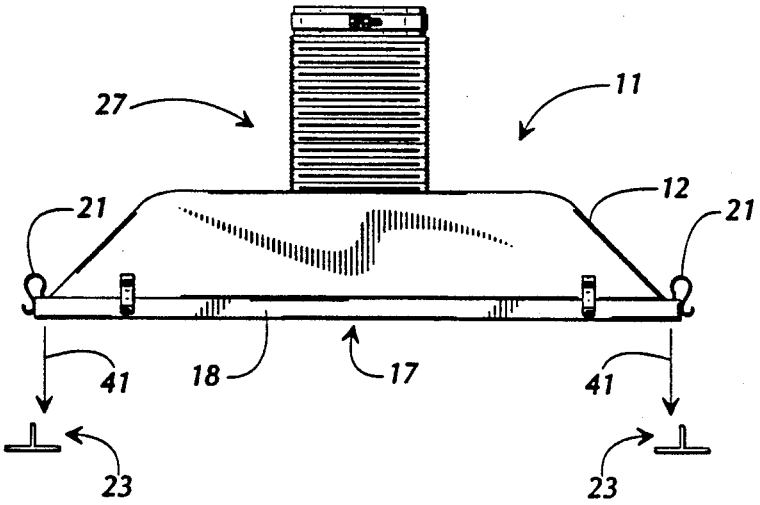

UNITARY VENT AND DUCT ASSEMBLY

TECHNICAL FIELD

The present invention relates generally to heating and air conditioning systems and more particularly to vents and ducts of the type commonly installed in suspended ceilings to facilitate the circulation of air within a room.

BACKGROUND OF THE INVENTION

For decades, suspended ceilings have been installed in commercial and private buildings as a relatively quick, efficient, and inexpensive alternative to traditional beam and sheetrock ceilings. Most suspended ceilings are formed from a grid of suspended metal spars that intersect to define square or rectangular framed sections into which lightweight ceiling panels are placed to complete the ceiling. In most suspended ceiling structures, the metal spars are formed with an inverted T-shaped cross-section that defines upstanding ridges extending longitudinally along the centers of the spars. Thus, the spars along the sides of each bounded section of the suspended grid define a bounded frame that receives, aligns, and supports a ceiling panel.

Over the years, numerous types of fixtures have been designed to be installed in the framed sections of suspended ceilings. For example, florescent light fixtures, surveillance camera domes, and loud-speaker panels have all been developed to fit within selected frame sections of a suspended ceiling structure to provide light, surveillance, music, and other amenities within a building.

In most modern buildings with suspended ceiling structures, the heating and air conditioning main supply and return ducts are also disposed, along with light fixtures, plumbing, and the like, above the level of the suspended ceiling. In these types of installations, the main supply and return ducts usually communicate with the interior of a room through vent and duct assemblies that, like florescent light fixtures, are sized to be received and supported within a framed section of the suspended ceiling structure. While these types of vent and duct assemblies have proven to be attractive and efficient in buildings with suspended ceilings, their assembly and installation can be and often is time consuming and frustrating for an installer. For example, some prior art vent and duct assemblies have been shipped in pieces and have required assembly prior to their installation within the suspended ceiling. Once assembled, the vent and duct assembly usually is manually positioned within a framed section of the suspended ceiling grid within a few feet of a main supply or return duct.

With the vent and duct assembly in place, the distance between the vent and duct assembly and the main supply duct is measured or estimated and a length of rigid or flexible duct is cut to be extended between the vent and duct assembly and the main supply or return duct. The cut flexible duct is then secured at one end to the vent and duct assembly and at its other end to the main supply or return duct. The vent and duct assembly is thus coupled to the heating and air conditioning system and serves as a conduit for circulating air within the room.

The installation of vent and duct assemblies as just described, while acceptable, has nevertheless been wrought with various problems and shortcomings inherent in the design of prior art vent and duct assemblies. For example, the sizing and cutting of flexible duct to extend between the assembly and main supply or return duct must be done very accurately to ensure proper fit and air flow. If the flexible duct assembly is cut too long, for example, it will tend to sag between its ends so that airflow becomes restricted. On the other hand, if the flexible duct is cut too short, it will tend to kink or collapse at its connection points to the main supply duct or to the vent and duct assembly, similarly restricting the flow of air through the assembly.

Even when the flexible duct is measured and cut to the proper length, its installation still can generate problems for a workman. For example, the flexible duct, once cut, is usually fastened to the vent and duct assembly and then stretched lengthwise to meet and be coupled to the main supply or return duct. Many times when the flexible duct is being stretched, the forces imparted to stretch the duct are sufficient to raise the vent and duct assembly out of position within the suspended ceiling grid so that the vent and duct assembly can become dislodged or even fall through the ceiling grid. Accordingly, the installation of these prior art vent and duct assemblies has often required two workers, one to hold the assembly and the other to stretch and connect the flexible duct.

It can thus be seen that installation of prior art vent and duct assemblies in suspended ceilings has been an inefficient, time consuming, and sometimes frustrating process for the installers. Furthermore, in very large buildings where hundreds of such assemblies must be installed, the total time required to install each assembly often necessitates additional installation crews to complete the job within schedule.

Accordingly, a continuing and heretofore unaddressed need exists for a vent and duct assembly that can be installed within a suspended ceiling quickly and easily by a single installer, that does not require preassembly, does not require the sizing and fitting of flexible duct between the assembly and the main supply or return duct, and that, once installed in the ceiling grid, is held firmly in place and does not become dislodged or fall through the grid during the installation process. It is to the provision of such a vent and duct assembly that the present invention is primarily directed.

SUMMARY OF THE INVENTION

Briefly described, the present invention is a unitary vent and duct assembly for installation within a framed section of a suspended ceiling structure adjacent to and above - ceiling main supply or return ceiling supply duct to which said vent and duct assembly is to be coupled. The assembly includes a cowling having a substantially closed top portion and a substantially open bottom portion. The bottom portion of the cowling is bounded by a periphery that is sized to fit and nestle within a selected framed section of the suspended ceiling structure. An at least partially foraminous grill is positioned over and covers the substantially open bottom portion of the cowling. When installed in a suspended ceiling, this grill is the only visible portion of the assembly from within the interior of the building within which the ceiling and the assembly is installed.

A plurality of omega-shaped spring biased clips are arrayed about the periphery of the cowling and are sized and configured to slip over the central ridges of the ceiling struts when the assembly is lowered into place within a framed section of the ceiling structure. In a preferred embodiment, the spring biased clips are provided with barbs that engage and attach the clips firmly but releasibly to the strut ridges as the vent and duct assembly is lowered into place. Each clip is formed with a handle portion that can be grasped to pull the clip apart and thus release it from engagement with the strut to facilitate movement or adjustment of the vent and duct assembly when necessary.

A semi-rigid preferably insulated flexible duct is precoupled at one end to the top portion of the cowling and communicates with the interior thereof for delivering air to or extracting air from the vent and duct assembly. The flexible duct, which preferably is formed of thin aluminum or a similarly suitable material, is shipped in an accordion-style collapsed configuration extending only a short distance above the cowling and terminating in a free open end. The flexible duct is lengthwise extendable by pulling and stretching it away from the cowling and the walls of the duct are sufficiently thick to support the duct once it is stretched to a particular length and shape.

During installation and attachment to a main supply or return duct, the vent and duct assembly of this invention is simply removed from its box and lowered into place within a framed section of the suspended ceiling structure. As the assembly is lowered into the frame section, the clips arrayed about its periphery slide over and grasp securely onto the bounding central ridges of the ceiling struts. Preferably, the vent and duct assembly is then pressed firmly into the framed section to seat and secure it firmly therein. Barbs formed in each of the clips engage and grip the central ridges of the ceiling spars to hold the entire assembly firmly in place.

Once positioned and secured within a framed section of the ceiling structure, the semi-rigid flexible duct coupled to the top of the vent and duct assembly is simply pulled or stretched up away from the vent and duct assembly to extend it lengthwise and, if required, angled to meet the main supply or return duct. As the flexible duct is thus pulled and stretched significant forces are imparted to the assembly. However, since the assembly is secured in place by the clips, the assembly does not become dislodged or dislocated by these forces as commonly occurs with prior art assemblies. In the preferred embodiment, a manually securable clamp is positioned about the free end of the flexible duct so that when the free end is positioned over a coupling port of the main supply duct, the clamp is simply tightened to secure the flexible duct to the supply duct and ensure no air leakage therebetween.

Since the flexible duct of this invention is semi-rigid, it supports itself both in shape and length when it is extended to meet the supply duct. Thus, the accurate measuring and cutting of flexible duct required with prior art assemblies is eliminated. Further, if the vent and duct assembly of this invention needs to be moved to another framed section of the ceiling structure, the semi-rigid flexible duct can simply be extended or retracted as required by the new position, thus eliminating the need to measure and cut a new flexible duct as would be the case with the prior art.

Thus, it is an object of this invention to provide a unitary vent and duct assembly that is easy to install in far less time than prior art vents and ducts.

Another object of the invention is to provide a vent and duct assembly that, once positioned within the suspended ceiling, secures itself firmly so that further installation steps do not tend to dislodge the assembly.

A further object of the invention is to provide a unitary vent and duct assembly having a pre-installed semi-rigid flexible duct that can be stretched to the necessary length and shape and that, once stretched, supports itself in such length and shape to prevent sagging or kinks that have inhibited airflow in prior art devices.

These and other objects, features, and advantages of the present invention will become more apparent upon review of the detailed description set forth below in conjunction with the accompanying drawings, brief descriptions of which follow.

BRIEF DESCRIPTION OF THE DRAWINGS

FIG. 3 is a partially sectioned view showing a peripheral edge of the present invention resting on a suspended ceiling strut and being secured thereto by the spring biased clip.

FIGS. 4A–4C are progressive side elevational views illustrating a preferred method of installing the vent and duct assembly of this invention.

DETAILED DESCRIPTION OF THE PREFERRED EMBODIMENT

Figure 1:
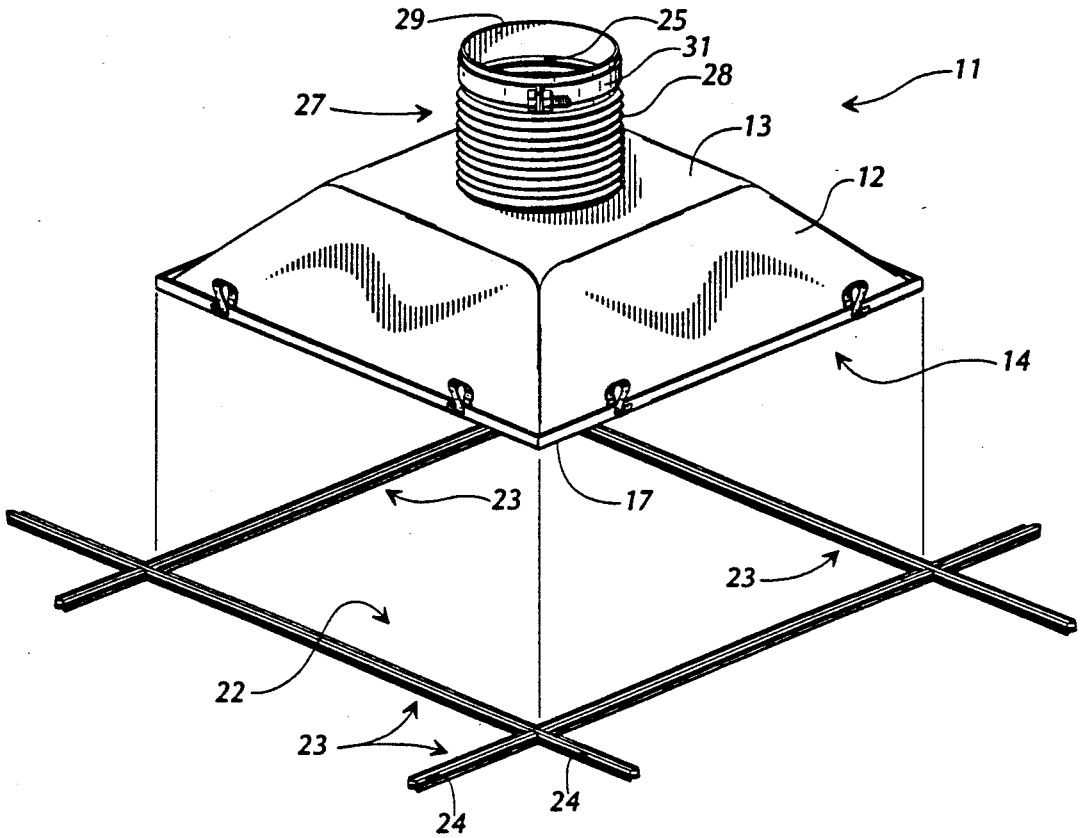
Fig. 1 is a perspective illustration of a vent and duct assembly embodying principals of the present invention in a preferred form.
Figure 2:
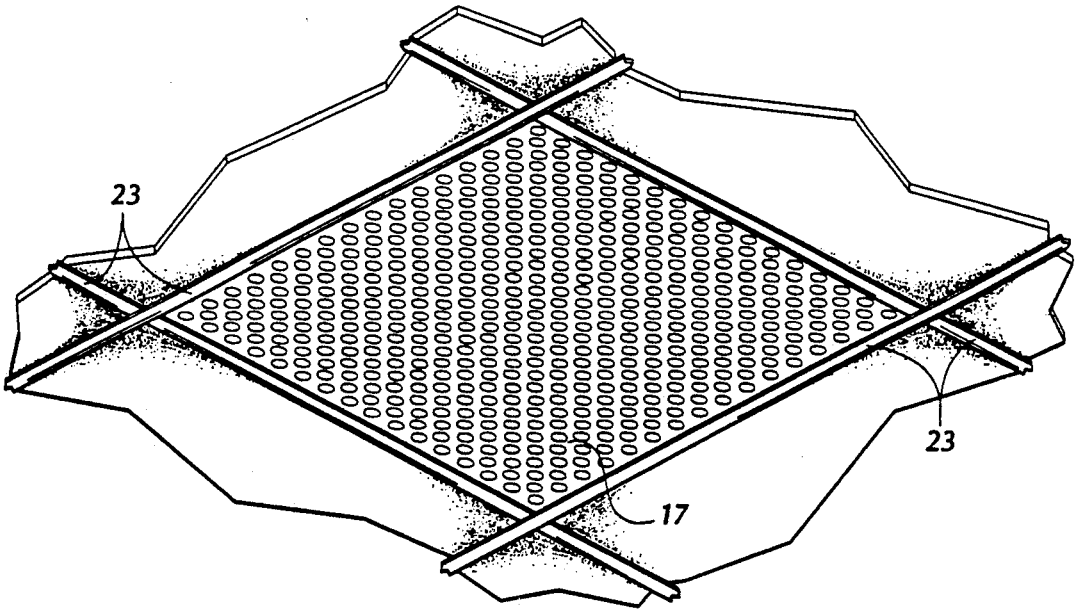
FIG. 2 is a perspective illustration showing from the bottom a portion of a suspended ceiling within which the vent and duct assembly of this invention has been installed.

Referring now in more detail to the drawings, in which like numerals refer to like parts throughout the several views, FIG. 1 illustrates in perspective, a vent and duct assembly that embodies principles of the present invention in a preferred form. The assembly 11 is seen to comprise a cowling 12 having a substantially closed top portion 13 and a substantially open bottom portion 14, which is obscured from view in FIG. 1. In the illustrated embodiment, the cowling 12 is seen to have a periphery 16 (FIG. 3) that is substantially square and from which slanted walls extend upwardly and inwardly to the top portion 13 of the cowling 12. While this particular configuration is common and suitable for installation in suspended ceilings of the type defining square framed sections, it will be understood that many other suitable shapes and configurations of the cowling 12 might be employed with equal or similar results depending upon the particular application. The cowling itself may be formed of pressed aluminum, vacuum molded plastic, composites, or any other suitable material.

An at least partially foraminous grill 17 is secured to the cowling 12 about its periphery and is positioned over and covers the substantially open bottom portion 14 of the cowling, as best illustrated in FIG. 3. Preferably, the foraminous grill 17 is formed with upturned edges 18 and the periphery 16 of the cowling 12 is sized to fit snugly around and just inside the upturned edges 18 as can be seen in FIG. 3. The cowling 12 and grill 17 are securely fastened together by means of feet 19 formed at the bottom of one leg of a plurality of clip assemblies 21, as described in more detail below.

The vent and duct assembly 11 of this invention is sized and configured to be installed within a selected framed section 22 of a suspended ceiling structure. The suspended ceiling structure is formed by elongated suspended metal struts 23 that intersect at right angles to form the framed sections of the ceiling. As best illustrated in FIG. 3, each of the elongated struts 23 is formed with an inverted T-shaped cross-section defining a longitudinal ridge 24 that extends upwardly along the length of the struts 23. With this configuration, the ridges 24 bound each of the framed sections of the ceiling structure with the legs 26 of the struts providing a ledge for supporting appliances, panels, or the like installed within the framed section.

A semi-rigid flexible duct 27 is pre-attached to the substantially closed top portion 13 of the cowling 12 and communicates with the interior of the cowling for delivering air to or extracting air from the vent and duct assembly 11. The vent and duct assembly 11 is shipped with the semi-rigid flexible duct 27 permanently attached thereto and ready for the installation process. Insulation 25, which may be fiberglass or any other suitable material, preferably is disposed about the interior of the flexible duct 27 to prevent heat loss during operation. This insulation may also be disposed about the exterior of the duct 27 if desired.

The flexible duct 27 has walls 28 that preferably are formed of aluminum or another suitable material and that are configured to be collapsed in accordion-like fashion to form a short compact storing and shipping configuration of the duct 27 as shown in FIG. 1. In this way, the vent and duct assembly of this invention can be shipped as an assembled unit without taking up an inordinate amount of space.

The thickness of the material from which the walls 28 of the duct 27 are formed is selected so that the duct 27 is lengthwise expandable by pulling or stretching it away from the assembly 11 thus spreading out the individual accordion folds. The thickness of the duct walls is also selected so that when stretched to a given length and shape, the duct 27 is supported by its walls in the configuration to which it has been stretched. Also, the duct 27 preferably is pre-insulated, either on its inside or about its exterior, with an appropriate insulating material such as fiberglass. The duct 27 terminates at its free end in a coupler 29 that is sized to fit over the standard coupling port of a main supply or return duct. A pre-installed clamp 31 is provided about the exterior of coupler 29 so that when the coupler is fitted over the coupling port of a supply or return duct, it can be secured firmly by tightening or other appropriate manipulation of the clamp 31.

FIG. 3 illustrates in detail one of the multi-function spring-biased clamp assemblies 21 of the present invention. The clamp assembly 21 is seen to be substantially omega-shaped having a first leg 32 and a second leg 33. The first leg 32 of the clip 21 is fastened to an upturned edge 18 of the grill 17 by means of a bolt 33 or other suitable fastener. The lower end of the clip first leg 32 is formed with a transversely extending foot 19 that, when the clip is fastened to the assembly, rests firmly atop the periphery 16 of the cowling 12 capturing it securely between the foot 19 and the grill 17. In this way, the clips 21 arrayed about the periphery of the assembly function first to secure the components of the invention securely together.

The second leg 33 of the clip 21 is formed to have a substantially serpentine shape and terminates in a curled-up handle portion 36 of the clip. The handle portion 36 provides a means for grasping the clip and pulling its second leg away from its first leg to dislodge the assembly from a suspended ceiling structure if desired for removal or repositioning of the vent and duct assembly. Each of the clips 21 is also preferably formed with an inwardly extending barb 37 that, when the vent and duct assembly is lowered into place within a framed section of the ceiling structure, engages an upstanding ridge 24 to lock the assembly securely in place within the ceiling structure. Should the assembly ever need to be removed, the handles 36 of the clips 21 can simply be grasped and pulled, which disengages the barbs 37 and releases the clips 21 from the upstanding ridges 24 of the struts 23.

Figure 4B:
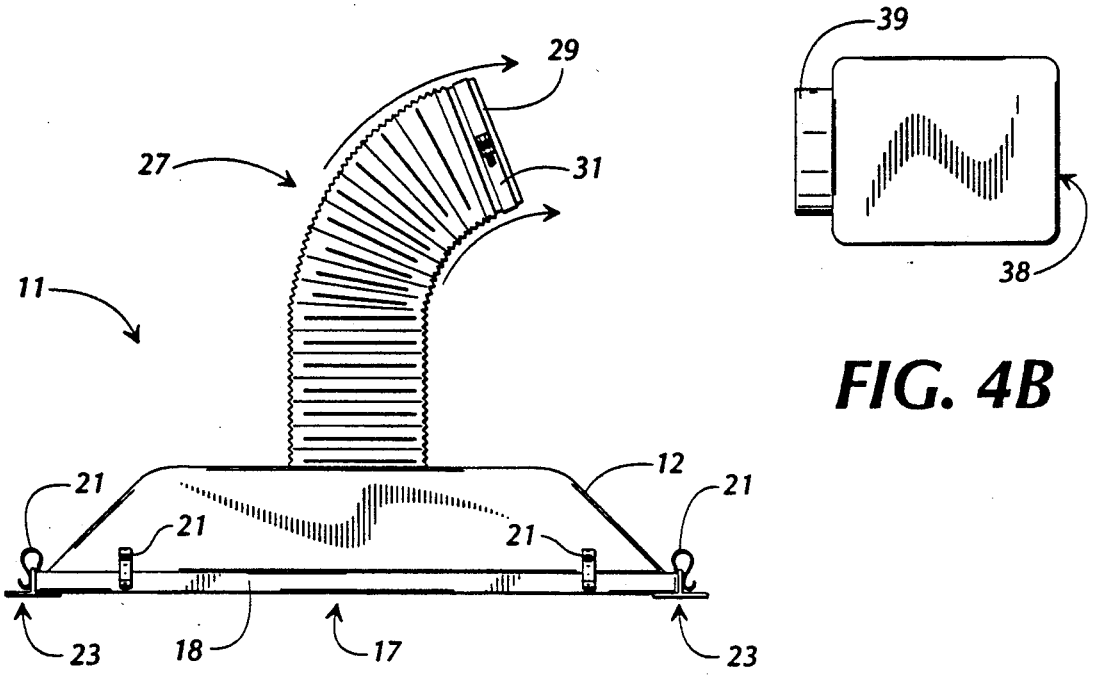
Figure 4C:
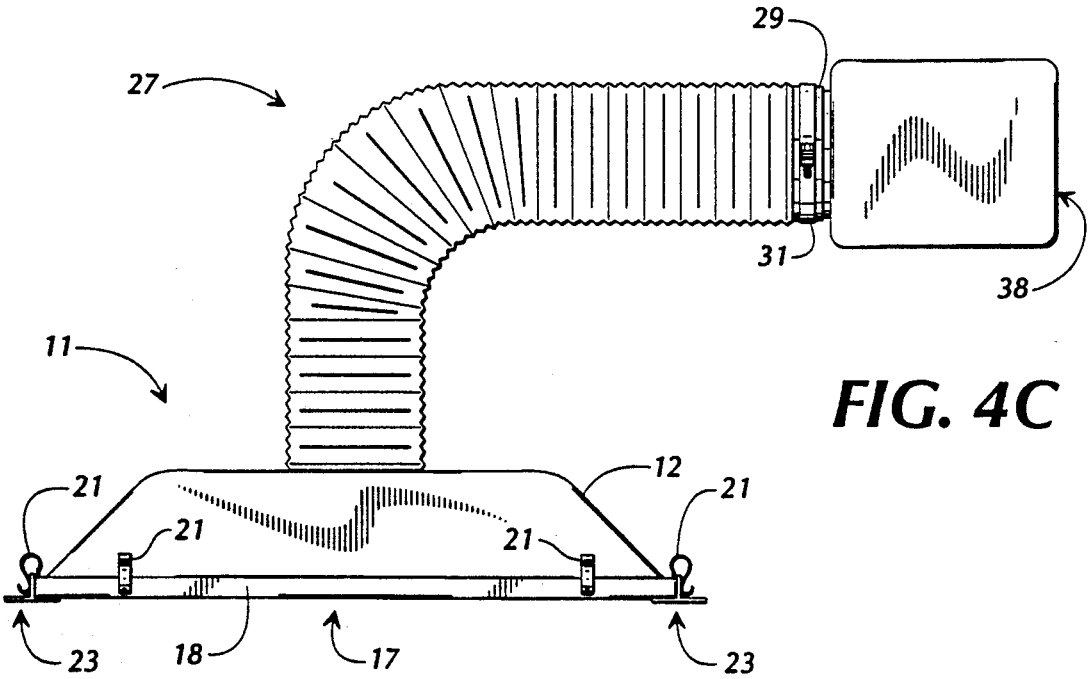

FIGS. 4A–4C illustrate in sequence how the improved vent and duct assembly of this invention is installed quickly, easy, efficiently, and effectively. In FIG. 4A, the vent and duct assembly 11, having been removed from its shipping carton, is lowered into place within a framed section of a suspended ceiling structure, the framed section being defined by suspended metal struts 23. As the vent and duct assembly is lowered into place as indicated by arrows 41, the clips 21, which are arrayed about the periphery of the assembly 11, engage and ride over the upstanding ridges 24 (FIG. 3) of the ceiling struts that form the framed section. The vent and duct assembly 11 can then be pressed firmly in a downward direction, which seats the assembly in place and engages the barbs 37 of the clips 21 with the ridges 24 of the struts 23, thus securing the vent and duct assembly 11 firmly in place within its framed section of the suspended ceiling structure.

With the vent and duct assembly 11 thus positioned and secured in place, the semi-rigid flexible duct 27, which previously has been configured in its accordion-folded compact shape, can be pulled or stretched upwardly and away from the cowling 12 toward the coupling port 39 of an adjacent main supply or return duct 38, to which the vent and duct assembly is to be coupled. Since the flexible duct 27 is semi-rigid as a result of the thickness of its walls, it tends to retain its length and shape as it is pulled away from the cowling 12. In practice, it is desirable to pull the flexible duct 27 first upwardly and thence to the side rather than directly toward the supply duct 38 to prevent any kinking that might otherwise occur.

As the flexible duct 27 continues to be stretched toward the supply duct 38, its coupler 29 meets and slips over the coupling port 39 of the main supply or return duct 38. At this point, the clamp 31 can be tightened and secured by means of a latch, screwdriver, or the like, thus fastening the coupler 29 firmly and air tightly about the coupling port 39.

Although substantial horizontal and vertical forces are imparted to the vent and duct assembly 11 during the process of pulling and stretching the flexible duct 27, the assembly is not dislodged from its position within the suspended ceiling as often occurs with prior art assemblies, since it is held firmly and securely in place by means of the spring biased clips 21. Accordingly, the vent and duct of this invention can be installed quickly and conveniently by a single workman who simply presses the assembly in place within the ceiling and then pulls the flexible duct 27 up and over to couple it to the main supply or return duct.

Not only is the vent and duct assembly of this invention easier, quicker, and more convenient to install, its design removes the requirement of measuring and cutting duct to span the space between the vent assembly and the main supply or return duct as required in the prior art. Further, since the semi-rigid flexible duct 27 maintains its length and shape when stretched and bent, it is always insured that the flexible duct will not be too long or too short and thus will not sag or form kinks that can restrict airflow and damage air conditioning equipment. Thus, the limitations of the prior art are met and solved by the unitary vent and duct assembly of the present invention.

The invention has been described herein in terms of preferred embodiments and methodologies. It will be obvious to those of skill in this art, however, that various modifications of the illustrated embodiment might well be made without departing from the scope of this invention. For example, while the foraminous grill 17 is shown with upturned edges and fastened to the cowling by means of the clips, many other suitable methods might be used to mate and attach the components of the system together with comparable results. Further, the spring biased clips themselves may well take on a configuration other than omega-shaped, although it is felt that this configuration is the most reasonable and economical. Furthermore, the insulation, which is shown to be disposed about the interior of flexible duct 27, could just as easily be predisposed about the exterior of the duct 27 without effecting the insulating properties of the assembly as a whole. These and many other additions, deletions, and modifications might well be made to the embodiments illustrated herein without departing from the spirit and scope of the invention as set forth in the claims.

I claim:

1. A unitary vent and duct assembly for installation within a framed section of a suspended ceiling structure adjacent to an above-ceiling supply duct to which said vent and duct assembly is to be coupled, said unitary vent and duct assembly comprising:

a cowling formed to have a substantially closed top portion and a substantially open bottom portion with said cowling having a periphery and being sized and configured to fit and nestle within a selected framed section of the suspended ceiling structure within which said vent and duct assembly is to be installed with the periphery of said cowling at least partially resting on and being supported by the frame of said suspended ceiling structure;

an at least partially foraminous grill positioned over and covering the substantially open bottom portion of said cowling;

means for securing said foraminous grill in position covering the substantially open bottom portion of said cowling;

clip means arrayed about the periphery of said cowling for releasibly but firmly securing said vent and duct assembly in place within the framed section of the suspended ceiling structure within which said vent and duct assembly has been positioned;

a semi-rigid flexible duct having walls and being precoupled at one end to the top portion of said cowling communicating with the interior thereof, said semi-rigid flexible duct having a free end and being lengthwise expandable between a compact storage configuration wherein the walls of said duct are accordion folded together and an expanded lengthened configuration for coupling of the free end of said semi-rigid flexible duct to the above-ceiling supply duct, the frame section of said suspended ceiling structure have struts of substantially inverted T-shaped cross-section forming an upstanding longitudinal ridge extending along the tops of the framing struts, said clip means comprises a plurality of spring biased clips arrayed about the periphery of said cowling, each of said clips being substantially omega-shaped defining a first leg of said clip and a second leg of said clip, said first leg of each of said clips being secured to said vent and duct assembly at the periphery of said cowling with the second leg of each clip being positioned to slip over and grip the longitudinal ridge of the suspended ceiling structure when said unitary vent and duct assembly is positioned within the framed section of the suspended ceiling structure.

whereby the unitary vent and duct, assembly can be place within the framed section of the suspended ceiling structure whereupon the clip means engages and secures the assembly to the suspended ceiling structure to hold the assembly in place and prevent the assembly from being pulled out of position when the semi-rigid flexible duct is stretched to its lengthwise expanded configuration for coupling to the supply duct.

2. A unitary vent and duct assembly as claimed in claim 1 and further comprising means on each of said clips providing a handle by which said clip can be grasped and sprung apart to release said clip from gripping relationship with its corresponding ridge and thus to release said vent and duct assembly from the suspended ceiling structure.

3. A unitary vent and duct assembly as claimed in claim 1 and further comprising a barb formed in the second leg of each of said clips with said barb being configured and positioned to engage the ridge of the suspended ceiling structure over which said second leg of said clip has slipped to fasten said clip securely to said ridge.

4. A unitary vent and duct assembly as claimed in claim 1 and wherein said grill is formed with upturned peripheral edges and wherein the periphery of said cowling extends adjacent to and just inside the upturned peripheral edges of said grill when said grill is in position covering the substantially closed bottom portion of said cowling, said first leg of each of said clips being fastened to an upturned peripheral edge of said grill and being formed with a foot that rests firmly against the periphery of said cowling to secure the cowling in place within the upturned peripheral edges of said grill and thus to secure said cowling and said grill firmly together.

5. A unitary vent and duct assembly as claimed in claim 1 and further comprising clamp means positioned about the free end of said semi-rigid flexible duct for securing said duct free end to the above-ceiling supply duct when said flexible duct is stretched to meet and be coupled to said supply duct.

6. A unitary vent and duct assembly as claimed in claim 1 and further comprising thermal insulation means positioned to insulate said semi-rigid flexible duct against thermal loss during operation.

7. A unitary vent and duct assembly as claimed in claim 6 and wherein said thermal insulation means is disposed about the interior of said flexible duct.

8. A unitary vent and duct assembly as claimed in claim 7 and wherein said thermal insulation means is disposed about the interior of said flexible duct.

* * * * *